United States Patent [19]

Miller

[11] Patent Number: 4,695,207

[45] Date of Patent: Sep. 22, 1987

[54] PNEUMATIC GATE OPERATOR AND OUTLET CAP

[75] Inventor: Roy W. Miller, Highland, Ind.

[73] Assignee: Pullman Rail Leasing Inc., Chicago, Ill.

[21] Appl. No.: 756,784

[22] Filed: Jul. 18, 1985

[51] Int. Cl.[4] ..... B65G 53/46

[52] U.S. Cl. ..... 406/130; 406/145; 222/505; 105/299

[58] Field of Search ..... 406/145, 128, 129, 130; 105/299; 222/153, 545, 556, 505; 292/104, 205, 240, 241

[56] References Cited

U.S. PATENT DOCUMENTS

| | | | |
|---|---|---|---|
| Re. 27,471 | 9/1972 | Mundinger | 406/129 |
| 2,915,022 | 12/1959 | Dorey | 105/299 X |
| 2,950,144 | 8/1960 | Dorey | 406/145 |
| 3,082,700 | 3/1963 | Dorey | 105/299 X |
| 3,100,457 | 8/1963 | Dorey | 105/299 X |
| 3,167,222 | 1/1965 | Koronda | 222/512 |
| 3,281,177 | 10/1966 | Tenenbaum | 292/241 |
| 3,482,741 | 12/1969 | Fritz | 222/554 |
| 3,583,768 | 6/1971 | Koranda | 406/118 |
| 3,632,174 | 1/1972 | Miller | 406/119 |
| 3,635,170 | 1/1972 | Chierici | 105/299 X |
| 3,637,262 | 1/1972 | Adler | 406/128 |
| 3,693,846 | 9/1972 | Schuller | 406/145 X |
| 4,114,785 | 9/1978 | Dugge | 406/145 X |
| 4,163,583 | 8/1979 | Hammonds | 406/145 |
| 4,312,607 | 1/1982 | Van Auken | 406/128 |
| 4,317,532 | 3/1982 | Przybylinski | 406/130 X |
| 4,382,724 | 5/1983 | Green | 406/130 |
| 4,388,026 | 6/1983 | Green | 406/130 |
| 4,411,560 | 10/1983 | McComb | 406/128 |
| 4,437,796 | 3/1984 | Schipper | 406/119 |

*Primary Examiner*—Robert J. Spar
*Assistant Examiner*—Jay I. Alexander
*Attorney, Agent, or Firm*—Richard J. Meyers & Associates

[57] ABSTRACT

A hopper discharge structure is provided with slope sheets defining a throat over a pneumatic outlet tube. The throat is closed by two sliding valve plates. The valve plates are moved by crank arrangements which provide an operator with varying mechanical advantage in operating the valve means. The crank arrangements are mounted on operating shafts extending the length of the hopper. The operating shafts extend through the hopper end walls and are adjustably supported for rotation by reinforcement plates adjustably mounted on the end walls. The operating shafts are equipped with handles which accommodate the insertion of an extension bar from two different directions. The outlet tube is covered by a hinged cap and locking structure. The cap is cammingly sealed over the end of the outlet tube by a cam lock and handle mounted on the locking structure. Outward force on the handle unlocks and withdraws the cap from the end of the outlet tube. The cap locking structure includes a catch which latches it away from the outlet tube in the open position.

24 Claims, 13 Drawing Figures

FIG. 3
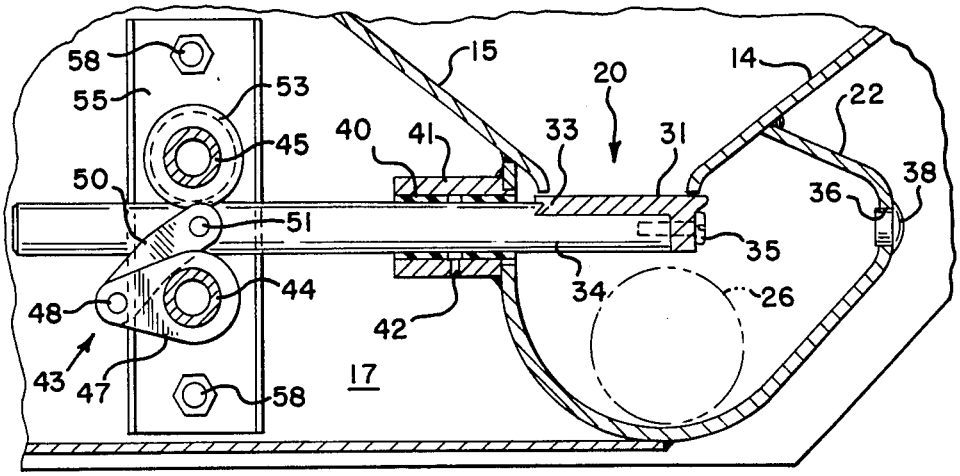
FIG. 4
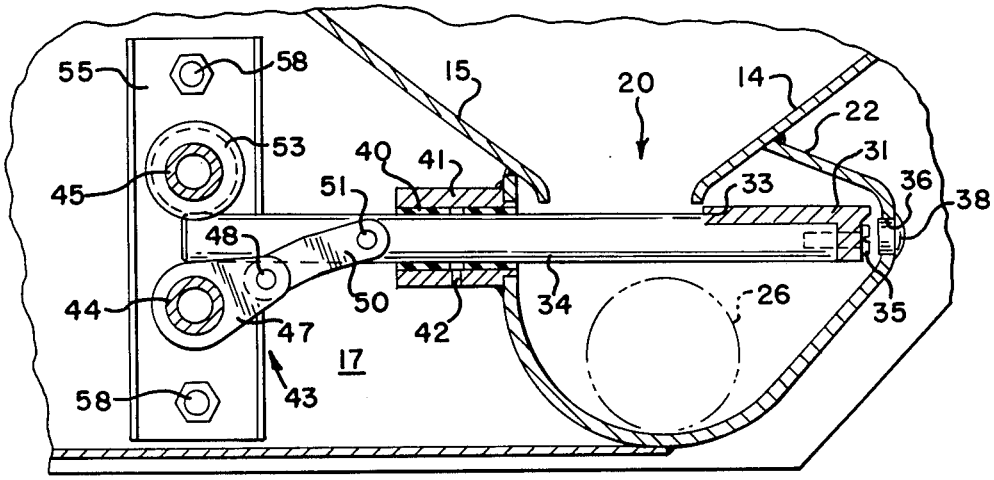
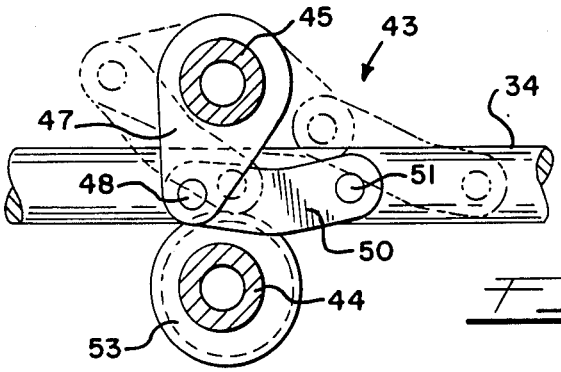
FIG. 5

16
14
15
64
63
65
67
62
61
68
66
71
72
88a
28
25
27
88
46
81a
81c
57
55
45
86
87
44
30
77
78
79
81
80a
80
76

19
16
22
85
63
65
64
83
82
67
66
71
27
62
72
61
68
25
28
88a
88
46
81c
81b
81a
55
45
56
54
86
79
81
80
77
76
30
13

PNEUMATIC GATE OPERATOR AND OUTLET CAP

BACKGROUND OF THE INVENTION

1. Field of the Invention

The present invention relates to pneumatic discharge arrangements for unloading lading from a transportation vehicle having a discharge hopper, such as a railway hopper car.

2. Description of the Prior Art

Pneumatic discharge arrangements for removing lading from a hopper are old and well-known. Pneumatic discharge for a hopper is particularly useful for lading materials that are particulate, granular, or pelletized, such as plastic pellets.

Various designs have been developed for this purpose. Usually, a control tube is supported below a tapering hopper. An opening in the lower portion of the hopper communicates with the control tube. A valve opens and closes the opening. When open, the valve allows lading to fall through the hopper into the control tube where it is drawn out by a vacuum intake connected thereto.

The lading may rest heavily on the valve, and the force required for an operator to initially move the valve may be quite considerable. Therefore, it is desirable to provide a relatively high mechanical advantage to the operator at this point in operation. Earlier designs provided for movement of the valve using rack-and-pinion arrangements which were vulnerable to misalignment and provided relatively little mechanical advantage to an operator initially opening and closing the valve.

In the prior art, the control tube is covered by caps which are hingedly supported on the hopper structure. Latches secure the caps when the control tube is sealed. It is desirable from the viewpoint of efficiency to provide a structure where the unlatching and pivoting of the cap is accomplished by a single operator action. The prior art latches are relatively complicated and do not provide this simplicity of action.

Also, the control tubes of older designs may be sealed while the gate is open. This risks the possibility of the hopper being filled while the gate is open which renders pneumatic unloading difficult or impossible due to the fact that the control tube becomes blocked and air flow therethrough cannot be readily established.

SUMMARY OF THE INVENTION

This invention provides an improved pneumatic discharge arrangement for hoppers which may be carried on a railway hopper car.

The valve plates in the discharge arrangement are operated by bell crank mechanisms on the operating shafts, giving reliable operation and varying mechanical advantage to the operator. The design of the control tube and the valve plates allows for easier fabrication and assembly of the valve mechanism.

The caps of the control tube are sealed by cam lock latches which unlatch responsive to outward tension and draw the cap away from the control tube in the same movement. When fully drawn away from the control tube, the cap latches in an open position to prevent damage due to uncontrolled swinging toward and away from the control tube.

The discharge operating handles are configured to allow insertion of a cheater bar on handle extension from two directions. The handles also are provided with bosses which allow the caps of the control tube to be closed only when the valve plates are in the closed position.

A movable reinforcement plate on the end walls of te discharge structure allows for positional adjustment of the operating shafts.

Other objects and advantages of the invention will be found in the specification and claims, and the scope of the invention will be set forth in the claims.

BRIEF DESCRIPTION OF THE DRAWINGS

FIG. 3 is a cross-sectional view taken along line 3—3 of FIG. 2, showing the valve plate in a closed position.

FIG. 4 is a view as in FIG. 3, but showing the valve plate in an open position.

FIG. 5 is an enlarged view similar to FIGS. 3 and 4, but showing several positions of a crank arrangement mounted on the lower operating shaft.

DESCRIPTION OF PREFERRED EMBODIMENT

Figure 1:
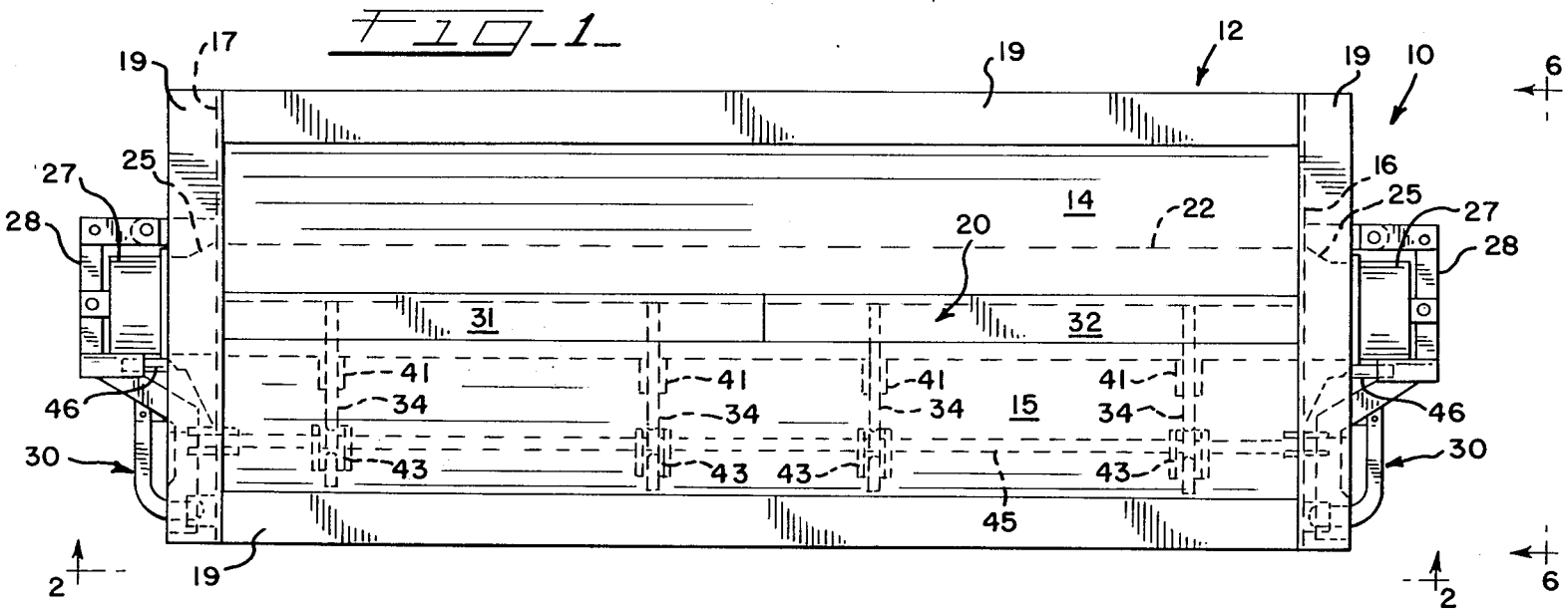
FIG. 1 is a top plan view of the hopper discharge structure of this invention.
Figure 2:
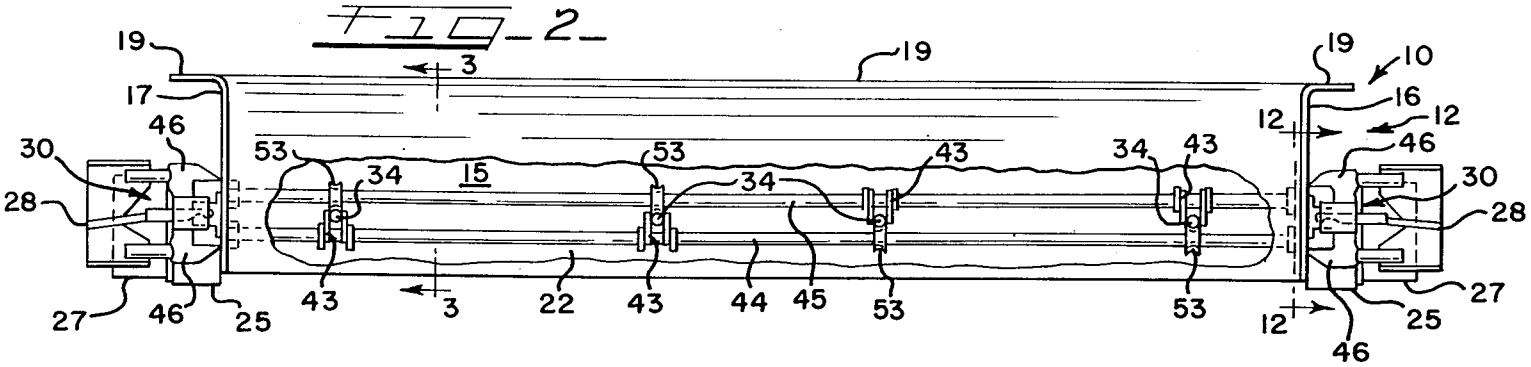
FIG. 2 is an elevational view taken at line 2—2 of FIG. 1.

Referring to FIGS. 1 and 2, a hopper discharge structure for unloading a hopper railway car is generally designated by reference numeral 10. The discharge structure 10 includes a discharge housing 12 having transversely-spaced, obliquely downward-extending slope sheets 14 and 15 connected at their opposite ends to end walls 16 and 17. The housing 12 is adapted to be suitably secured to the discharge end of a hopper structure supported on a railway hopper car. To facilitate connection to a hopper structure, attaching flanges 19 are connected to the upper ends of slope sheets 14 and 15 and end walls 16 and 17. The flanges extend outwardly and horizontally therefrom and may be mechanically or otherwise fastened to a hopper structure.

As best shown in FIG. 3, the lower terminal ends of slope sheets 14 and 15 define a throat or discharge opening generally designated by reference number 20 through which the lading in the hopper passes during unloading.

If the particles of lading are amendable to intercohesion, they may combine to bridge over the throat 20 and prevent the lading from falling through. In order to prevent this, the throat 20 is made wide enough to avoid bridging of most particulate types of lading, the throat 20 in the preferred embodiment being approximately 3 inches wide.

As best shown in FIG. 3, the control tube or plenum chamber 22 is located below the throat 20 of the discharge housing 12. The control tube 22 extends through end walls 16 and 17, as an outlet tube 25 extending outward at each end of the discharge housing 12.

The control tube 22 is sized to accommodate insertion of a probe to clear the tube. The standard probe is a three-and-one-half inch diameter vacuum intake tube which is slid into the control tube 22 through one of the outlet tubes 25. The outer diameter of the probe is indicated in FIGS. 3 and 4 by refrence number 26.

Each outlet tube 25 is equipped with a cap 27 adapted to seal the end of the outlet tube 25. Each cap 27 is mounted on a hinged arm 28 which pivots toward and away from the outlet tube 25. A latching structure 30 on each hinged arm 28 latches the hinged arm 28 in a position where the cap 27 is in sealing engagement over the end of the outlet tube 25.

The lower ends of the slope sheets 14 and 15 meet a pair of valve plates 31 and 32 supported longitudinally end to end (See FIGS. 1 and 3). Each of the valve plates 31 and 32 is adapted to cover a longitudinal segment of the throat 20. The valve plates 31 and 32 may be independently moved laterally to open and close the longitudinal segments of throat 20. The sheets 14 and 15 curve to extend vertically downward in the throat 20, thereby meeting the valve plates 31 and 32 at a perpendicular angle and eliminating the need for a seal between the valve plates 31 and 32 and the slope sheets 14 and 15.

In usual operation, the caps 27 on both ends of the outlet tubes 25 of control tube 22 are opened, and a vacuum intake (not shown) is connected to one of the outlet tubes 25. Air is admitted through the opposite outlet tube 25 and flows through the control tube 22 to the vacuum intake. In order to effectively withdraw the lading from the hopper, the longitudinal segment of the throat 20 farther from the vacuum intake is opened while the closer valve plate remains closed. Lading particles in the farther side of the hopper fall through the throat 20 into the control tube 22, where the air flow carries the particles along the control tube 22, through the outlet tube 25, and into the vacuum intake. When the lading on the side of the hopper opposite the vacuum intake has been unloaded, the valve plate on the farther side is closed and the nearer valve plate is opened, allowing the lading in the nearer side of the hopper to fall into the control tube 22 and to be drawn into the vacuum intake.

As best shown in FIGS. 3 and 4, the valve plates 31 and 32 are supported by movable support members or operating rods 34. The valve plates 31 and 32 are configured with interlock portions 33 to interlock with the ends of operating rods 34 and are rigidly connected to the operating rods 34 by valve attachment bolts 35. The valve attachment bolts 35 are easily accessible for removal or installation of valve plates 31 and 32 through access bores 36. When not in use, the bores 36 are sealed by means of plugs 38.

The operating rods 34 extend into the control tube 22 through bearing members or bushings 40 which are held within bushing retainers 41. The bushings 40 support the operating rods 34 for horizontal sliding movement with a minimum of wear and friction. The bushings 40 and the bushing retainers 41 are equipped with a drain hole 42 to allow the escape of any material which may work its way between the operating rods 34 and their respective bushings 40.

As best shown in FIGS. 3, 4, and 5, the horizontal movement of the operating rods 34 and the valve plates 31 and 32 is accomplished by crank arrangements, generally indicated at 43, mounted on the operating shafts 44 and 45.

The operating shafts 44 and 45 are disposed one above the other in a generally vertical plane, and extend the length of the discharge housing 12 and through the end walls 16 and 17. An operating handle 46 is mounted on each end of each of the operating shafts 44 and 45, enabling an operator to manually rotate the operating shafts 44 and 45. As best visible in FIG. 2, for valve plate 31, the crank arrangement 43 is on the lower shaft 44. The other valve plate 32, the crank arrangement 43 is on the upper shaft 45, as in FIG. 5. This allows independent movement of each of the valve plates 31 and 32 responsive to independent rotation of the operating shafts 44 and 45 respectively.

As best shown in FIG. 5, the crank arrangement 43 consists of a crank member 47 mounted on one of the operating shafts 44 and 45. Pivot 48 connects crank member 47 to connector member 50. Connector member 50 is pivotally connected to operating rod 34 by pivot 51. A roller 53 on the other of the operating shafts 44 and 45 engages the operating rod 34 to ensure that the operating rod 34 remains in a single horizontal plane throughout its movement.

FIG. 5 shows several positions of the crank arrangement 43. The nature of the crank arrangement 43 provides varying mechanical advantage for forces applied to the valve plates 31 and 32 by an operator. The highest mechanical advantage is present at the beginning of the movement to open the valve plates 31 and 32 and at the beginning of the movement to close the valve plates 31 and 32. In the crank arrangement 43 shown in the preferred embodiment, the mechanical advantage present during the first 5° of rotation of the operating shaft 44 (shown in phantom in FIG. 5) and during the last 5° of rotation of the operating shaft (also shown in phantom in FIG. 5) is approximately five times that available during 5° of the middle span of rotation of the operating shaft 45 (shown in solid lines in FIG. 5). This added mechanical advantage is present when most needed. When the valve plates 31 and 32 are first moved to open the throat 20, usually the lading in the hopper discharge structure 10 is resting against the valve plates 31 and 32, resisting the initial movement. When the valve plates 31 and 32 are first moved to close the throat 20, particles of lading may remain in the throat 20, offering initial resistance.

Figure 12:
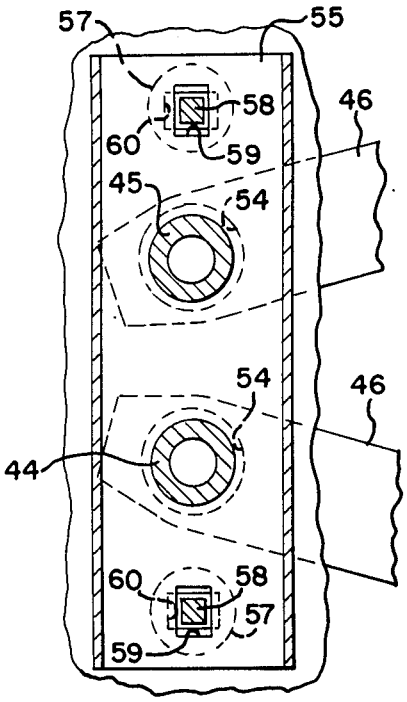
FIG. 12 is an enlarged cross-sectional view taken along line 12—12 of FIG. 2 and showing the adjustable reinforcement plate supported on the hopper end wall.

The precise vertical and horizontal position of the operating shafts 44 and 45 is adjustable. As best shown in FIG. 12, the operating shafts 44 and 45 extend through apertures or bores 54 in end walls 16 and 17. The bores 54 are larger than the operating shafts 44 and 45 and allow the shafts 44 and 45 to move vertically and horizontally. The shafts 44 and 45 extend through reinforcement member or plate 55 which has bores which fit closely around shafts 44 and 45. The shafts 44 and 45 are secured against sliding movement through the bores in plate 55 by collars 56 (FIG. 7) mounted on each shaft 44 and 45 immediately inward of the plate 55.

The reinforcement plate 55 is bolted to the end wall 16. The bolts 58 used for the connection have a square cross-section for a portion of their length and an enlarged round head 57. The reinforcing plate 55 has rectangular slots 59 and the end wall 16 has rectangular slots 60. Slots 59 extend vertically and slots 60 extend horizontally, superimposing on each other to form a square aperture through which bolt 58 may be inserted. the rectangular shape of the slots 59 and 60 allows limited vertical and horizontal movement of the reinforcement plate 55 when the bolt 58 is loosened.

Figure 6:
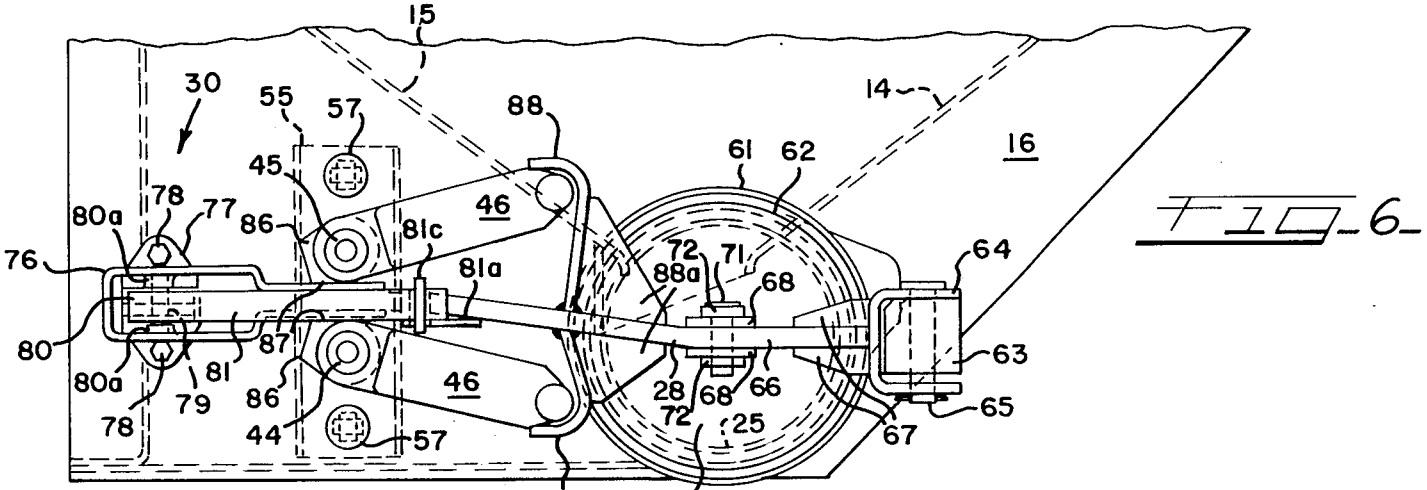
FIG. 6 is an end view of the hopper discharge structure taken at line 6—6 of FIG. 1.
Figure 7:
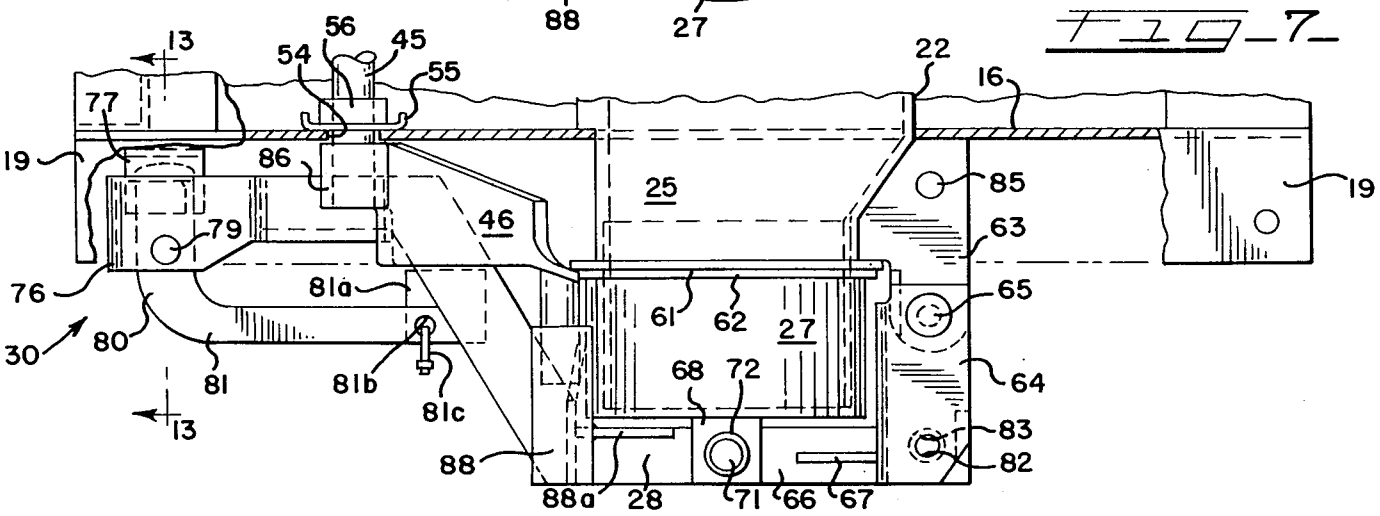
FIG. 7 is a plan view of FIG. 6 with portions of the attaching flanges broken away.

FIGS. 6 and 7 best disclose the structure surrounding the outlet tube cap 27 on each end of the discharge housing 12. Cap 27 is sealed against an annular abutment surface 61 on the outlet tube 25. The seal is maintained by gasket 62.

A hinge member 63 is attached to the side of the outlet tube 25. A hinge channel portion 64 is pivotally connected to hinge member 63 by hinge pin 65 to form a hinge structure.

Hinge channel portion 64 supports cap locking arm 66 for hinged movement. Locking arm 66 extends away from the hinge structure and across the cap 27. The weld of the locking arm 66 to the hinge channel portion 64 is strengthened by gussets 67.

At the approximate centerpoint of the cap 27, cap mounting flanges 68 are welded to the cap 27. The flanges 68 extend outward from the cap 27 and are connected to the locking arm 66 by pivot pin 71. The tightness of the seal of the cap 27 over the end of outlet tube 25 is set when the cap 27 and latching structure 30 are assembled.

Flanges 68 have slots therein which allow adjusting movement of pin 71 relative to locking arm 66 during assembly. The pin 71 extends through close-fitting washers or adjustment members 72 which are welded to the flanges 68 at the time of assembly in the position giving the desired tightness of seal of cap 27.

The locking arm 66 extends past the cap 27 and then bends toward the end wall 16 passing beteen operating handles 46. A support means or loop brace 76 is attached to the end of the locking arm 66 opposite the hinge channel portion 64. The loop brace 76 fits over cam lock bracket 77, which supports the weight of one end of the latching structure 30. Cam lock bracket 77 is mounted on the outward surface of the end wall 16 by connection means or bolts 78 extending through the end wall 16.

Cam lock pivot pin 79 passes through the loop brace 76 and pivotally connects cam lock 80 to the loop brace 76. The cam lock 80 is supported in the center of loop brace 76 by spacers **80*a*. Cam lock 80 is equipped with a handle 81 for operating the latching structure 30. Cam lock 80 is engageable with cam lock bracket 77 when the loop brace is fitted over the cam lock bracket 77**.

Figure 13:
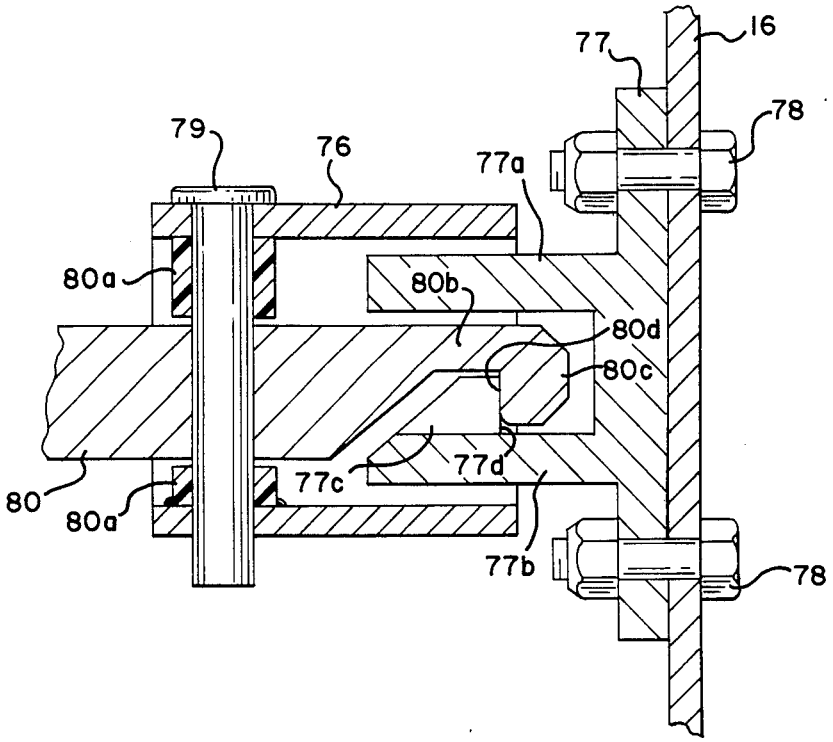
FIG. 13 is an enlarged cross-sectional view taken along line 13—13 of FIG. 7 and showing the cam lock arrangement.

As best shown in FIG. 13, cam lock bracket 77 has an upper wall **77*a* and a lower wall 77*b* adapted to receive camming part 80*b* of cam lock 80. Lower wall 77*b* has an upwardly extending portion 77*c* thereon which has a curved inward-facing bracket camming surface 77*d*. Camming part 80*b* has a downward extending portion 80*c* thereon which has an outward facing cam lock camming surface 80*d*. Rotation of the cam lock 80*c* when engaged with the cam lock bracket 77 causes a camming interaction between the cam lock camming surface 80*d* and the bracket camming surface 77*d* which draws the locking arm 66 pivotally toward the end wall 16, and, as a consequence, presses the cap 27 sealingly against the gasket 62 and the annular abutment surface 61, sealing the control tube 22. When the full camming movement has been completed, the end of handle 81 abuts the locking arm 66**.

To unseal the latching structure 30 and the attached cap 27, the operator grasps the cam lock handle 81 and draws it away from end wall 16. Initially, this causes the cam lock 80 to rotate and release the camming pressure applied to seal the cap 27. The cam lock 80 then rotates to a point where camming surfaces **77*d* and 80*d* are no longer in contact and cam lock 80 is disengaged from cam lock bracket 77. Continued pulling of the handle 81 by the operator causes the latch arrangement 30 and the cap 27 to pivot away from the outlet tube 25**.

For placing a security seal on the hopper, a security plate or security member **81*a* is mounted on the locking arm 66 below the point of abutment of the cam lock handle 81**.

The cam lock handle 81 and the security plate **81*a* are provided with security apertures or bores 81*b* which are aligned when the latching structure 30 is sealed. A security means 81*c*, acting as a lock or a seal, may be extended through the bore 81*b* and around the locking arm 66. Once the security means 81*c* is employed, opening the latching structure 30 requires removal of the security means 81*c***.

Figure 8:
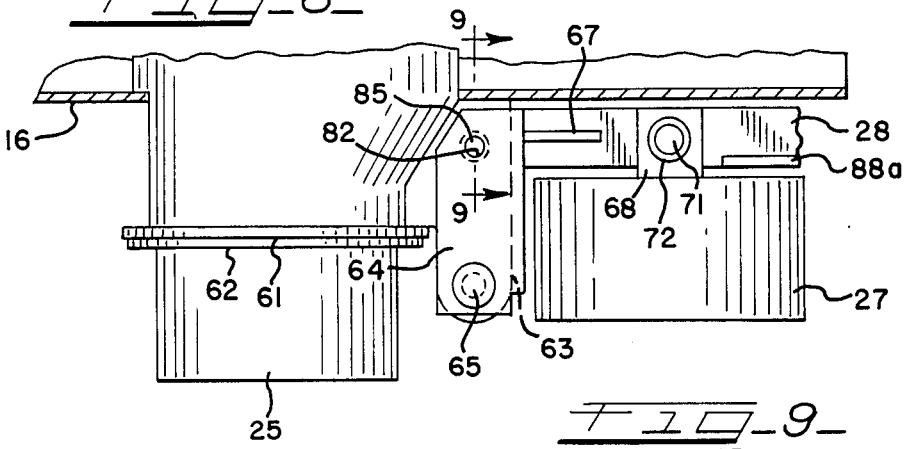
FIG. 8 is a view similar to FIG. 7 showing the outlet tube cap latched in an open position.
Figure 9:
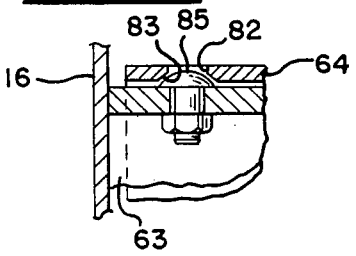
FIG. 9 is an enlarged cross-sectional view of the catch arrangement taken along line 9—9 in FIG. 8.

As best shown in FIG. 8, the latching structure 30 and the attached cap 27 may be swung open to catch in the open position. Hinge channel portion 64 pivots about hinge pin 65 and fits over hinge member 63. As best shown in FIG. 9, an aperture or bore 82 extends through the upper flange of the hinge channel member 64. At its lower end, the bore 82 flares to form a downward-facing chamfer 83. This chamfer 83 coacts with catch member or round bolt head 85 protruding above the surface of hinge member 63 to latchingly retain the hinge channel portion 64, the attached hinged arm 28, and the cap 27 in the open position.

As best shown in FIG. 6, the locking arm 66 extends between the two handles 46 on the ends of the operating shafts 44 and 45 when the cap 27 is sealed over the outlet tube 25. The handles 46 are equipped with protrusions or bosses 86 and flats 87. The bosses 86 are situated so as to prevent sealing of the cap 27 until the handles 46 are rotated to close the throat 20. The flats 87 engage with the locking arm 66 when the cap 27 is sealed and the bosses 86 prevent rotation of the handles 46 to open the throat 20.

The handles 46 are also secured against rotation when the cap 27 is sealed by locking clip 88. The clip 88 is mounted on the locking arm 66 and reinforced by gussets **88*a*. The clip 88 extends outwardly from the locking arm 66 and has a cross-section which extends generally vertically upward and downwad from the locking arm 66, then curves to entrap and retain both handles 46 in the closed position. When the latch structure 30 is moved away from the outlet tube 25, the clip 88 is moved therewith, releasing the handles 46 for opening and closing the throat 20**.

Figure 10:
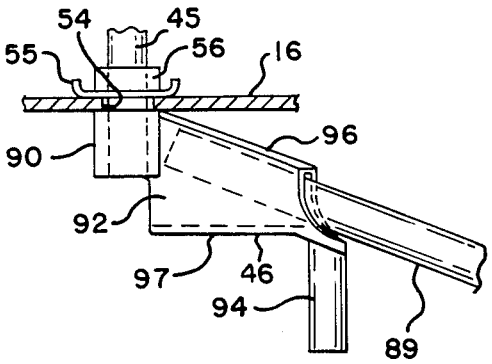
FIG. 10 is a plan view of one of the operating handles having a cheater bar inserted therein.
Figure 11:
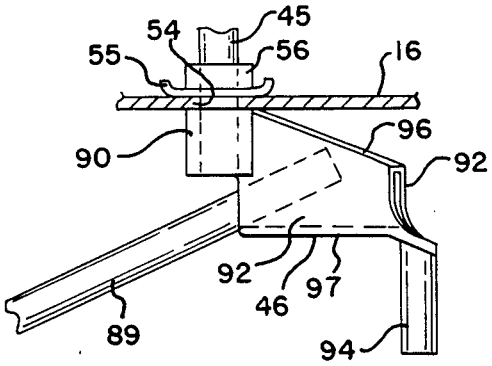
FIG. 11 is a view as in FIG. 10 where the cheater bar is inserted from the opposite side.

As best shown in FIGS. 10 and 11, the handles 46 are configured to permit the insertion of a cheater bar or extension 89 which increases the torque that a human operator can impart to the operating shafts 44 and 45. The handle 46 includes a shaft mounting portion 90 mounted on operating shaft 44 and 45. Two spaced handle side walls 92 extend radially away from the mounting portion 90 to meet a grip portion 94. Inner and outer support plates 96 and 97 rigidify the structure.

As shown in FIG. 10, a cheater bar 89 may be inserted through an opening in the handle 46 into the space between the handle side walls 92 to extend the operative length of the handle 46 beyound the grip portion 94. Alternatively, as shown in FIG. 11, the cheater bar 89 may be inserted between the handle side walls 92 to extend in the opposite direction from the direction of extensions of the side walls 92. This dual-position design allows ready use of a cheater bar 89 with the handle 46 on either of the operating shafts 44 and 45 no matter what the orientation of the handle 46.

The foregoing description and the drawings are given merely to explain and illustrate the invention and the invention is not to be limited thereto, except insofar as the appended claims are so limited, since those skilled in the art who have this disclosure before them will be able to make modification and variations therein without departing from the scope of the invention.

I claim:

1. In a pneumatic discharge hopper having an end wall and an outlet tube extending through the end wall, a sealing arrangement for covering the end of the outlet tube, the sealing arrangement comprising:

a hinge structure affixed to the end wall for supporting the sealing arrangement;

a locking arm attached to the hinge structure for pivoted movement toward and away from the end wall;

a cap being adapted to cover and seal the end of the outlet tube and being supported on the locking arm for pivoted movement therewith toward and away from the outlet tube;

the locking arm extending across the cap;

cam lock means mounted on the locking arm; and a cam lock bracket on the end wall, the cam lock bracket being adapted to receive and cammingly coact with the cam lock means for securing the locking arm and sealing the cap over the end of the outlet tube.

2. The invention according to claim 1 and the cam lock means comprising:

a camming portion cammingly engageable with the cam lock bracket; and a handle means connected with the camming portion whereby force directed away from the end wall on the handle means moves the camming portion to disengage from the cam lock bracket and draws the locking arm and cap hingedly away from the end of the outlet tube.

3. The invention according to claim 1, and the locking arm having support means, said support means being received by the cam lock bracket and being cooperative with the cam lock bracket to align the cam lock means and the cam lock bracket for camming coaction and for supporting the locking arm and the cap during said camming coaction.

4. The invention according to claim 1, and the cam lock bracket having an upper wall portion and a lower wall portion adapted to receive the cam lock means therebetween for maintaining camming contact of the cam lock means and the cam lock bracket.

5. The invention according to claim 1, and the hinge structure including a hinge member mounted on the end wall; and a hinge portion pivotally connected with the hinge member and supporting the locking arm;

the hinge member having a catch member thereon engageable with the hinge portion for latchingly retaining the cap away from the outlet tube when the locking arm is fully pivoted away from the outlet tube.

6. The invention according to claim 5, and the hinge member having aperture means and the catch member being latchingly secured within the aperture means.

7. The invention according to claim 6, and the aperture means having a lowered chamfered portion adapted to receive the catch member, thereby providing for easy latching and unlatching of the cap arrangement.

8. The invention according to claim 1, and the hopper having an opening communicating with the interior of the hopper and the outlet tube;

means for opening and closing the opening;

operating handle means being rotatably supported on the end wall and operatively associated with the means for opening and closing the opening whereby the opening may be opened and closed by manual rotation of the handle means.

9. The invention according to claim 8, and clip means supported on the locking arm, the handle means being engaged by the clip means in the closed position of the cap immobilizing said means for opening and closing said opening in a closed position of the latter.

10. The invention according to claim 2, and the handle means having a first security aperture and, a security member on the locking arm, said security member having a second security aperture, and security means extending through the first and and second security apertures during their alignment with one another securing the cap sealing arrangement.

11. A pneumatic hopper discharge structure comprising:

a discharge housing including a pair of transversely spaced downward sloping walls forming an opening and a pair of end walls connected to the ends of the downward sloping walls;

a control tube supported below the discharge housing and communicating with the opening;

movable valve support means supported on the discharge structure for movement with respect to the discharge housing;

valve means supported on the movable support means and positioned for movement with respect to the discharge housing to open and close the opening;

a crank arrangement being connected with the movable support means for movement of the movable support means and of the valve means;

a first valve operating shaft supported on the end walls and extending longtudinally of the discharge structure below one of the downward sloping walls, the operating shaft being connected with the crank arrangement providing rotation of the operating shaft to open and close the opening;

the crank arrangement including a crank member being fixedly mounted on the operating shaft; and a connector member having two end portions, one end portion having a pivotal connection with the crank member and the other end portion being pivotally connected with the movable support means providing a varying mechanical advantage being greatest during initial movement of the valve means in the opening in opening and closing thereof;

the distance on the crank member from the operating shaft to the pivotal connection being substantially equal to the vertical distance from the operating shaft to the movable support means for efficient load transfer during opening and closing of the valve means.

12. The invention according to claim 11, and a second operating shaft being situated above the first operating shaft in a substantially vertical plane.

13. A pneumatic hopper discharge structure comprising:

a discharge housing including a pair of transversely spaced downward sloping walls forming an opening and a pair of end walls connected to the ends of the downwrd sloping walls;

a control tube supported below the discharge housing and communicating with the opening;

movable valve support means supported on the discharge structure for movement with respect to the discharge housing;

valve means supported on the movable support means and positioned for movement with respect to the discharge housing to open and close the opening at either end of the discharge housing;

crank arrangements being connected with the movable support means for movement of the movable support means and of the valve means;

first and second valve operating shafts supported on the end walls and extending longitudinally of the discharge structure below one of the downward sloping walls, the operating shafts being connected with the crank arrangements providing rotation of one of the operating shafts to open and close the opening at one end of the dischage housing, and rotation of the other of the operating shafts to open and close the opening at the other end of the discharge housing;

each crank arrangement including a crank member being fixedly mounted on one of the operating shafts, and a connector member having two end portions, one end portion being pivotally connected with the crank member and the other end portion being pivotally connected with the movable support means providing a varying mechanical advantage being greatest during initial movement of the valve means in the opening in opening and closing thereof; and one of the end walls having apertures therein;

the operating shafts extending through the apertures;

The apertures being larger than the operating shafts, providing for vertical and horizontal adjusting movement thereof; and a reinforcement member supported on side one of the end walls and supporting the operating shafts;

the reinforcement member being supportable on the end wall in a plurality of fixed adjusted positions relative to the apertures in supporting the operating shafts in a plurality of adjusted positions.

14. A pneumatic hopper discharge structure comprising:

a discharge housing including a pair of transversely spaced downward sloping walls forming an opening and a pair of end walls connected to the ends of the downward sloping walls;

a control tube supported below the discharge housing and communicating with the opening;

movable valve support means supported on the discharge structure for movement with respect to the discharge housing;

valve means supported on the movable support means and positioned for movement with respect to the discharge housing to open and close the opening at either end of the discharge housing;

crank arrangements being connected with the movable support means for movement of the movable support means and of the valve means;

first and second valve operating shafts supported on the ends walls and extending longitudinally of the discharge structure below one of the downward sloping walls, the operating shafts being connected with the crank arrangements providing rotation of one of the operating shafts to open and close the opening at one end of the discharge housing, and rotation of the other of the operating shafts to open an close the opening at the other end of the discharge housing;

each crank arrangement including a crank member being fixedly mounted on one of the operating shafts, and a connector member having two end portions, one end portion being pivotally connected with the crank member and the other end portion being pivotally connected with the movable support means providing a varying mechanical advantage being greatest during initial movement of the valve means in the opening in opening and closing thereof;

the operating shafts having end portions extending through at least one of the end walls and each end portion having a handle thereon, each handle comprising a shaft mounting portion mounted on the end portion of the operating shaft;

a pair of side portions connected to the shaft mounting portion and extending away therefrom, the side portions defining a space therebetween;

a handle portion connected to the side portions for manual rotation of the operating shafts;

the handle having two openings therein communicating with the space between the side portions whereby an extension member may be inserted through one of the openings to extend the operative length of the handle beyond the handle portion in the direction of extension of the side portions and whereby the extension member may be inserted through the the other opening to extend the operative length of the handle in the opposite direction, providing the operator with increased leverage for turning the operating shafts.

15. A pneumatic hopper discharge structure comprising:

a discharge housing including a pair of transversely spaced downward sloping walls forming an opening and a pair of end walls connected to the ends of the downward sloping walls;

a control tube supported below the discharge housing and communicating with the opening;

movable valve support means supported on the discharge structure for movement with respect to the discharge housing;

valve means supported on the movable support means and positioned for movement with respect to the discharge housing to open and close the opening;

a crank arrangement being connected with the movable support means for movement of the movable support means and of the valve means;

a first valve operating shaft supported on the end walls and extending longitudinally of the discharge structure below one of the downward sloping walls, the operating shaft being connected with the crank arrangement providing rotation of the operating shaft to open and close the opening;

the crank arrangement including a crank member being fixedly mounted on the operating shaft; and a connector member having two end portions, one end portion having a pivotal connection with the crank member and the other end portion being pivotally connected with the movable support means providing a varying mechanical advantage being greatest during initial movement of the valve means in the opening in opening and closing thereof;

the distance on the crank member from the operating shaft to the pivotal connection being substantially equal to the vertical distance from the operating shaft to the movable support means for efficient load transfer during opening and closing of the valve means;

the opening having first and second longitudinal segements;

the valve means including first and second valve plates adapted to cover respectively the first and second longitudinal segments

16. A pneumatic hopper discharge structure comprising:

discharge housing including a pair of transversely spaced downward sloping walls forming an opening and a pair of end walls connected to the ends of the downward sloping walls;

a control tube supported below the discharge housing and communicating with the opening;

movable valve support means supported on the discharge structure for movement with respect to the discharge housing;

valve means supported on the movable support means and positioned for movement with respect to the discharge housing to open and close the opening;

a crank arrangement being connected with the movable support means for movement of the movable support means and of the valve means;

a first valve operating shaft supported on the end walls and extending longitudinally of the discharge structure below one of the downward sloping walls, the operating shaft being connected with the crank arrangement providing rotation of the operating shaft to open and close the opening;

the crank arrangement including a crank member being fixedly mounted on the operating shaft; and a connector member having two end portions, one end portion having a pivotal connection with the crank member and the other end portion being pivotally connected with the movable support means providing a varying mechanical advantage being greatest during initial movement of the valve means in the opening in opening and closing thereof;

the distance on the crank member between the operating shaft and the pivotal connection being substantially equal to the distance between the operating shaft and the movable support means to improve efficiency in the movement of opening and closing the valve means; and the control tube having bearing members supported thereon;

the movable support means comprising rod members extending through and slidably supported within the bearing members;

the bearing members having drain openings therein to allow the escape of material between the bearing members and the rod members.

17. A pneumatic hopper discharge structure comprising:

discharge housing including a pair of transversely spaced downward sloping walls forming an opening and a pair of end walls connected to the ends of the downward sloping walls;

a control tube supported below the discharge housing and communicating with the opening;

movable valve support means supported on the discharge structure for movement with respect to the discharge housing;

valve means supported on the movable support means and positioned for movement with respect to the discharge housing to open and close the opening;

a crank arrangement being connected with the movable support means for movement of the movable support means and of the valve means;

a first valve operating shaft supported on the end walls and extending longitudinally of the discharge structure below one of the downward sloping walls, the operating shaft being connected with the crank arrangement providing rotation of the operating shaft to open and close the opening;

the crank arrangement including a crank member being fixedly mounted on the operating shaft; and a connector member having two end portions, one end portion having a pivotal connection with the crank member and the other end portion being pivotally connected with the movable support means providing a varying mechanical advantage being greatest during initial movement of the valve means in the opening in opening and closing thereof;

the distance on the crank member from the operating shaft to the pivotal connection being substantially equal to the vertical distance from the operating shaft to the movable support means for efficient load transfer during opening and closing of the valve means;

a second operating shaft being situated above the first operating shaft in a substantially vertical plane; and the operating shafts having roller means mounted thereon, the roller means engaging said movable support means for supporting said support means in sliding motion.

18. A pneumatic hopper discharge structure comprising:

a discharge housing including a pair of transversely spaced downward sloping walls forming an opening and a pair of end walls connected to the ends of the downward sloping walls;

a control tube supported below the discharge housing and communicating with the opening;

movable valve support means supported on the discharge structure for movement with respect to the discharge housing;

valve means supported on the movable support means and positioned for movement with respect to the discharge housing to open and close the opening at either end of the discharge housing;

crank arrangements being connected with the movable support means for movement of the movable support means and of the valve means;

first and second valve operating shafts supported on the end walls and extending longitudinally of the discharge structure below one of the downward sloping walls, the operating shafts being connected with the crank arrangements providign rotation of one of the operating shafts to open and close the opening at one end of the discharge housing, and rotation of the other of the operating shafts to open and close the opening at the other end of the discharge housing;

each crank arrangement including a crank member being fixedly mounted on one of the operating shafts, and a connector member having two end portions, one end portion being pivotally connected with the crank member and the other end portion being pivotally connected with the movable support means providing a varying mechanical advantage being greatest during initial movement of the valve means in the opening in opening and closing thereof;

the distance on the crank member between the operating shaft and the pivotal connection being substantially equal to the distance between the operating shaft and the movable support means to improve efficiency in the movement of opening and closing the valve means;

the valve means and the movable support means having interlocking end portions for securing the valve means to the support means, and securing means coupling the end portions to one another the securing means being in axial alignment with the movement of the movable support means, thereby simplifying installation of the valve means.

19. A pneumatic hopper discharge structure comprising:

a discharge housing including a pair of transversely spaced downward sloping walls forming an opening and a pair of end walls connected to the ends of the downward sloping walls;

a control tube supported below the discharge housing and communicating with the opening;

movable valve support means supported on the discharge structure for movement with respect to the discharge housing;

valve means supported on the movable support means and positioned for movement with respect to the discharge housing to open and close the opening at either end of the discharge housing;

crank arrangements being connected with the movable support means for movement of the movable support means and of the valve means;

first and second valve operating shafts supported on the end walls and extending longitudinally of the discharge structure below one of the downward sloping walls, the operating shafts being connected with the crank arrangements providing rotation of one of the operating shafts to open and close the opening at one end of the discharge housing, and rotation of the other of the operating shafts to open and close the opening at the other end of the discharge housing;

each crank arrangement including a crank member being fixedly mounted on one of the operating shafts, and a connector member having two end portions, one end portion being pivotally connected with the crank member and the other end portion being pivotally connected with the movable support means providing a varying mechanical advantage being greatest during initial movement of the valve means in the opening and closing thereof;

the valve means and the movable support means having interlocking end portions for securing the valve means to the support means, and securing means coupling the end portions to one another, the securing means being in axial alignment with the movement of the movable support means, thereby simplifying installation of the valve means; and the control tube having access opening therein for access to the securing means.

20. A pneumatic hopper discharge structure comprising:

a discharge housing including a pair of transversely spaced downward sloping walls forming an opening;

a control tube supported below the discharge housing and communicating with the opening;

the control tube having bearing means supported thereon;

movable valve support means supported on the bearing means for movement with respect to the discharge housing;

valve means supported on the movable support means and positioned for movement with respect to the discharge housing to open and close the opening;

valve moving means connected with the movable support means for movement of the valve means;

operating shaft means rotatably supported on the discharge housing and connected with the valve moving means for moving the valve means responsive to rotation of the operating shaft means; and the movable support means including a movable support member having a terminal end portion within the control tube;

said support member having a valve support portion including a first interlock portion;

said valve means having a second interlock portion entrappingly engaged by the first interlock portion to prevent movement of the valve means away from the support member;

said valve means having a securement portion adjacent the terminal end portion of the support member;

securing means extending in axial alignment with the movement of the support member and engaging the securement portion and the support member, said securing means holding the first and second interlock portions in engagement and securing the valve means against movement with respect to the support member.

21. The invention according to claim 20, and the control tube having openings therein for access to the securing means to facilitate installation and replacement of the valve means.

22. A pneumatic hopper discharge structure comprising:

a discharge housing having a pair of transversely-spaced downward sloping walls forming an opening and an end wall connected to one end of each of the sloping walls;

a control tube supported below the discharge housing and communicating with the opening, the control tube having an end portion extending through the end wall;

movable valve support means supported on the discharge structure for movement with respect to the discharge housing;

valve means supported on the movable support means and positioned for movement with respect to the discharge housing to open and close the opening at either end of the discharge housing;

crank arrangements connected with the movable support means for moving the movable support means and the valve means;

first and second valve operating shafts supported on the end wall below one of the sloping walls, each of the operating shafts having an end portion extending through the end wall;

the operating shafts supporting the crank arrangements providing rotation of one of the operating shafts to open and close the opening at one end of the discharge housing, and rotation of the other of the operating shafts to open and close the opening at the other end of the discharge housing;

each crank arrangement including a crank member being fixedly mounted on one of the operating shafts, and a connector member having two end portions, one end portion being pivotally connected with the crank member and the other end portion being pivotally connected with the movable support means providing a varying mechanical advantage being greatest during initial movement of the valve means in the opening and closing thereof;

a cap arrangement supported on the end wall for sealing the end portion of the control tube, the cap arrangement including:

hinge means mounted on the end wall;

a locking arm connected with the hinge means for hinged movement toward and away from the end portion of the control tube;

a cap being supported on the locking arm for hinged movement therewith and being adapted to seal the end portion of the control tube;

a cam lock means on the end of the locking arm distal to the hinge means;

a cam lock bracket on the end wall receiving said cam lock means, the cam lock means cammingly engaging the cam lock bracket for sealing the cap arrangement over the end portion of the control tube; and first and second handle means mounted on the end portions of the first and second operating shafts respectively for operator movement of the valve means to open and close the opening;

each of the handle means having protrusion means thereon engaging the locking arm when the cap arrangement is sealed, securing the opening in a closed position and preventing sealing of the cap when the opening is open.

23. The invention according to claim 22, and clip means on the locking arm and engaging the handle means in the cap closed position, immobilizing said valve means with the opening closed.

24. A pneumatic hopper discharge structure comprising:

a discharge housing including a pair of transversely spaced downward sloping walls forming an opening and a pair of end walls connected to the ends of the downward sloping walls;

a control tube supported below the discharge housing and communicating with the opening;

movable valve support means supported on the discharge housing for movement with respect thereto;

valve means supported on the movable support means and positioned for movement with respect to the disicharge housing to open and close the opening;

an operating shaft rotatably supported on the discharge housing;

valve moving means connecting the operating shaft with the valve support means for moving said valve support means and said valve means responsive to rotation of the operating shaft;

the operating shaft having an end portion extending through one of the end walls and the end portion having a handle thereon, said handle comprising:

a shaft mounting portion mounted on the end portion of the operating shaft;

a pair of side portions connected to the shaft mounting portion and extending away therefrom, the side portions defining a space therebetween;

a handle portion connected to the side portions for manual rotation of the operating shafts;

the handle having two openings therein communicating with the space between the side portions whereby an extension member may be inserted through one of the openings to extend the operative length of the handle beyond the handle portion in the direction of extension of the side portions and whereby the extension member may be inserted through the other opening to extend the operative length of the handle in the opposite direction, providing the operator with increased leverage for turning the operating shafts.

* * * * *